United States Patent [19]

Fulmer, Sr. et al.

[11] 4,097,870

[45] Jun. 27, 1978

[54] ACTIVE SLEEVE SURROUNDING FEED LINE FOR DIPOLE ANTENNA

[75] Inventors: Leon F. Fulmer, Sr., Prosperity; John R. Lewis, Jr., Newberry, both of S.C.

[73] Assignee: Shakespeare Company, Columbia, S.C.

[21] Appl. No.: 722,498

[22] Filed: Sep. 13, 1976

[51] Int. Cl.[2] ..... H01Q 9/16

[52] U.S. Cl. ..... 343/792; 343/884

[58] Field of Search ..... 29/600; 343/715, 792, 343/895, 900, 884

[56] References Cited

U.S. PATENT DOCUMENTS

| | | | |
|---|---|---|---|
| 2,966,679 | 12/1960 | Harris | 343/895 |
| 3,769,622 | 10/1973 | Munson | 343/792 |
| 3,932,873 | 1/1976 | Garcia | 343/792 |

FOREIGN PATENT DOCUMENTS

| | | | |
|---|---|---|---|
| 807,693 | 1/1959 | United Kingdom | 343/873 |

*Primary Examiner*—Eli Lieberman

*Attorney, Agent, or Firm*—Hamilton, Renner & Kenner

[57] ABSTRACT

Disclosed is an apparatus forming at least a portion of an antenna and the method of constructing the same. A generally cylindrical casing is formed to hold a spacer having a generally cylindrical outer surface. The spacer has a generally axial aperture extending therethrough to receive an antenna transmission line so that the line will be spaced from the outer surface of the spacer and the casing. An antenna wire is braided around the outer surface of the spacer to locate the same between the spacer and the casing.

7 Claims, 2 Drawing Figures

ACTIVE SLEEVE SURROUNDING FEED LINE FOR DIPOLE ANTENNA

BACKGROUND OF THE INVENTION

This invention relates to antennas and the construction of at least a portion thereof. More particularly, this invention relates to the formation of the skirt portion of an antenna, such as one used for Citizen's Band (CB) radios and the like.

As the use of CB radios and the like becomes more prevalent, so also does the need for a reliable, inexpensive and facilely manufactured antenna. Many CB antennas are constructed primarily of plastics or fiberglass and include a mounting pedestal or base, an intermediate skirt portion and the upper whip portion. These dipole antennas can often be quite lengthy with, for example, half-wave lengths being quite common. In these instances, usually the skirt portion forms the lower quarter-wave segment of the half-wave dipole with the whip portion functioning as the other quarter-wave length of the vertical dipole.

For purposes of reliability, sensitivity and durability, the construction of the plastic skirt portion is quite important. The prior art relative to this portion of an antenna provides an adequately reliable device, but is difficult to manufacture which adds to the cost thereof. The primary problem is the insertion and centering of the inner transmission line within the outer casing. To this end, usually a urethane compound is foamed into a rectangular log and then fabricated into a cylindrical core by first sawing and the dowelling it into the final cylindrical shape. A radially extending slot is then cut along the entire length of the core and extending slightly past the center of the cylinder to receive the transmission line therein. The remaining slot is then filled with an additional piece of urethane foam which is shaped to conform with the outer cylindrical surface of the core. Then the second conductor of the dipole is braided around the core and the entire core used as a permanent mandrel and run through a tubular rod machine where it is cured to an outer casing, often made of a fiberglass reinforced plastic. The end result is a fiberglass tube filled with the urethane foam, cured thereto, with the transmission line passing generally centrally therethrough and the second conductor lying just inside the outer casing. The skirt can then be assembled with the remaining portions of the antenna. Such construction is not only tedious and time consuming, but it also fails to assure that the transmission line is precisely centrally located. In addition, because of the vast number of hand operations, the overall cost of the antenna is significantly increased.

SUMMARY OF THE INVENTION

It is therefore a primary object of the present invention to provide an antenna which is fabricated by a simple and efficient method of construction utilizing far fewer steps than the prior art.

It is another object of the present invention to provide an antenna, as above, in which the skirt portion is assured of having a uniformly centered transmission line therein with an outer conductor spaced uniformly from the transmission line.

It is a further object of the present invention to provide a sturdy and inexpensively produced antenna.

These and other objects of the present invention, which will become apparent from the description of the preferred embodiment, are accomplished by the means hereinafter described and claimed.

In general, the apparatus which forms at least a portion of an antenna and the method of manufacture thereof includes an outer generally cylindrical casing which is formed to hold a spacer therein. The spacer is formed with a generally cylindrical outer surface around which an antenna wire is braided and includes an axially extending aperture therethrough to receive an antenna transmission line.

DESCRIPTION OF THE PREFERRED EMBODIMENT

Figure 1:
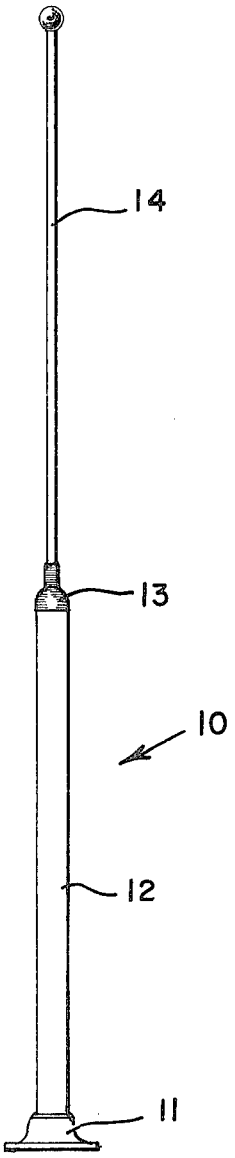
FIG. 1 is a generally schematic view of an antenna having a skirt portion manufactured according to the concept of the present invention.

A typical vertical whip dipole antenna is shown schematically in FIG. 1 and indicated generally by the numeral 10. Antenna 10 includes a conventional base or mounting portion 11 utilized to mount the antenna to a vehicle or the like; a skirt portion 12 providing a degree of rigidity to the otherwise long, flexible antenna; an insulation cap 13 mounted on top of skirt portion 12; and a whip portion 14.

Figure 2:
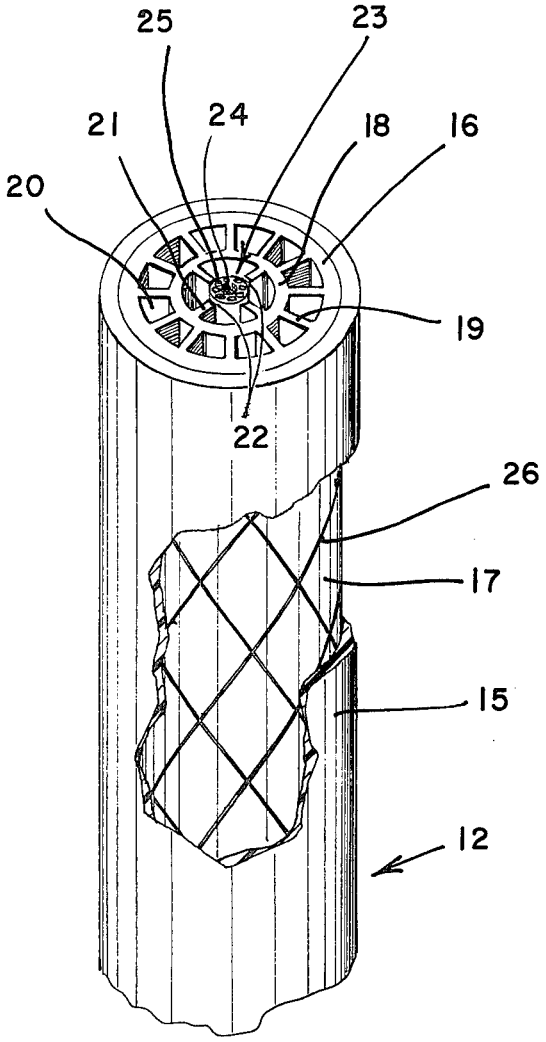
FIG. 2 is a partial perspective view having portions broken away and showing the details of the skirt portion of the antenna shown in FIG. 1.

The details of skirt portion 12 of antenna 10 are shown in FIG. 2 as including an outer casing or tube 15 which can be plastic, preferably a fiberglass reinforced plastic. Casing 15 is formed by a curing process and is generally in the form of a hollow cylinder having both ends open. Casing 15 receives a plastic spacer member 16 which can be made of any rigid plastic, such as filled or unfilled thermoplastic or thermoset, usually through the extrusion process. Spacer 16 is shown as having an outer generally cylindrical surface 17, the external diameter of which is just less than the internal diameter of casing 15. In cross-section, spacer 16 takes on the general appearance of a partial honeycomb, there being an inner cylindrical member 18 having a plurality of radial spokes 19 extending along the entire length thereof to the inner surface of cylindrical surface 17, thereby defining a plurality of compartments 20 shaped, in cross-section, like sectors of an annulus. A plurality of centering lugs 21 extend radially inward from ring 18 to define an aperture 22 which runs axially of the entire spacer 16 in the center thereof. To add structural rigidity to the spacer, lugs 21 are preferably radially misaligned with spokes 19 and are thus generally radially aligned with compartments 20.

An antenna transmission line 23 is received within aperture 22 to extend the entire length of spacer 16. Dependent on the type of antenna employed, line 23 could be a single wire forming the inner conductor of the antenna or, as shown, could be a coaxial cable having a conductor 24 forming the inner conductor of the antenna and a plurality of outer conductors 25 forming the outer conductor of the antenna. Inner conductor 24 extends through insulation cap 13 to form the whip portion 14 of the antenna. The outer cylindrical surface 17 of spacer 16 receives a thin wire 26 braided along the entire length of spacer 16. Wire 26 is thus uniformly spaced from line 23. This wire is electrically connected to the outer conductors 25 of the coaxial cable of transmission line 23, usually at or near the bottom of skirt 12, for example, in the base portion 11 of antenna 10. Wire 26 thus serves to increase the reception and transmission qualities of the antenna, the outer conductor of which might have been otherwise shielded by the plastic spacer 16.

The construction and assembly of the skirt 12 of antenna 10 should be evident. The spacer 16 is extruded and the transmission line 23 threaded into aperture 22. The outer wire 26 is braided over the outer surface 17 of spacer 16 and the spacer may then either be encapsulated by the casing 15 by being directly inserted into a already formed casing 15, or spacer 16 can be used as a permanent mandrel in a machine which forms the casing 15 and cured directly thereto. In either event, the skirt portion 12 of the antenna so formed, may then be assembled with the remaining portions of the antenna 10 as shown in FIG. 1.

It should also be appreciated that the method and apparatus according to the invention described herein could have applicability to forming portions of an antenna other than the skirt portion and indeed, under certain circumstances, essentially an entire antenna could be so constructed, if desired.

Thus, it is evident that an antenna constructed according to the concept of the present invention, as described herein, accomplishes the objects of the present invention and otherwise substantially improves the antenna construction art.

What is claimed is:

1. Apparatus forming at least a portion of an antenna comprising: an outer generally cylindrical casing, rigid one-piece spacer means within said casing having a generally cylindrical outer surface and a honeycomb-like interior including a medial cylindrical member and a plurality of centering lug means extending radially inward from said cylindrical member and together defining an axial aperture spaced from said outer surface, a transmission line positionable in said aperture and centered within said lug means, and a wire braided around the outer surface of said spacer means and uniformly spaced from said transmission line.

2. Apparatus, according to claim 1, wherein the outer surface of said spacer means is of a diameter slightly less than the inner diameter of said casing, said spacer means being slidably received in said casing.

3. Apparatus, according to claim 1, wherein said spacer means is attached to said casing.

4. Apparatus, according to claim 1, further comprising spoke means extending from said cylindrical member radially outwardly to said outer surface thereby defining a plurality of compartments of the honeycomb-like interior.

5. Apparatus, according to claim 4, wherein said centering lug means are generally radially aligned with said compartments.

6. Apparatus, according to claim 1, wherein said casing is made of a fiberglass reinforced plastic and said spacer means is made of plastic.

7. Apparatus, according to claim 1, wherein said transmission line is a coaxial cable having a first conductor and a plurality of second conductors, said second conductors being electrically connected to said wire.

* * * * *